United States Patent [19]

Jackson

[11] 4,089,915

[45] * May 16, 1978

[54] SELF-STERILIZING HUMIDIFIER

[76] Inventor: Richard R. Jackson, Eight Trinity Rd., Marblehead, Mass. 01947

[ * ] Notice: The portion of the term of this patent subsequent to May 31, 1994, has been disclaimed.

[21] Appl. No.: 741,705

[22] Filed: Nov. 15, 1976

[51] Int. Cl.[2] ..... B01F 3/04; F24F 13/04

[52] U.S. Cl. ..... 261/39 R; 261/80; 261/142; 261/DIG. 46; 55/243; 55/232; 55/279

[58] Field of Search ..... 21/91, 92, 2, 107, 93, 21/99; 55/243, 232, 279, 242; 68/15, 207; 261/80, 92, DIG. 46, 39 R

[56] References Cited

U.S. PATENT DOCUMENTS

| | | | |
|---|---|---|---|
| 3,867,485 | 2/1975 | Yeagle | 261/7 |
| 3,873,806 | 3/1975 | Schossow | 219/273 |
| 3,952,181 | 4/1976 | Reed | 219/272 |

*Primary Examiner*—Tim R. Miles
*Assistant Examiner*—Jon Hokanson

[57] ABSTRACT

A self-sterilizing humidifier for air to be breathed, of the type having endless porous media driven to be progressively immersed in a receptacle. Means are shown for periodically providing throughout the effective volume of water in the receptacle heated water at a temperature above about 180° F while the media drive is actuated, the heated water being sufficient to progressively expose the media to bacteria-killing conditions. In one embodiment a heater chamber automatically discharges a charge of water heated above about 180° F into the receptacle. In one such case a thermal actuator has sensitive parts exposed to water in both the heater chamber and the receptacle, the actuator releasing the charge when water in the receptacle lies below its sensitive part, and water in the heater chamber has reached or exceeds the selected high temperature. In another embodiment the heater element is in the receptacle and is periodically energized to maintain bacteria-killing conditions while the blower in the air flow path is de-energized to reduce evaporative cooling of the media and water during the sterilization interval.

12 Claims, 4 Drawing Figures

Figure 1:
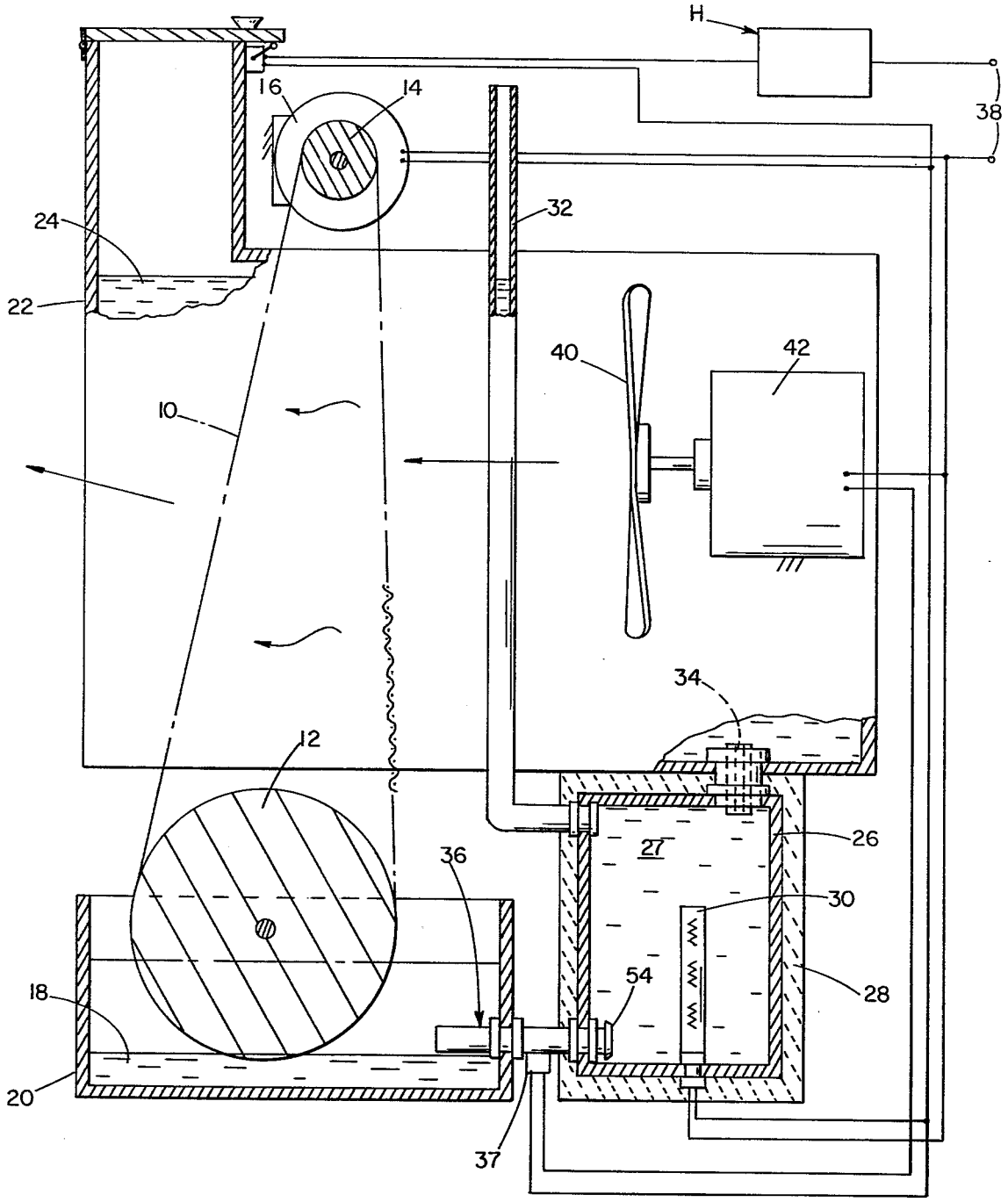

FIG 1A
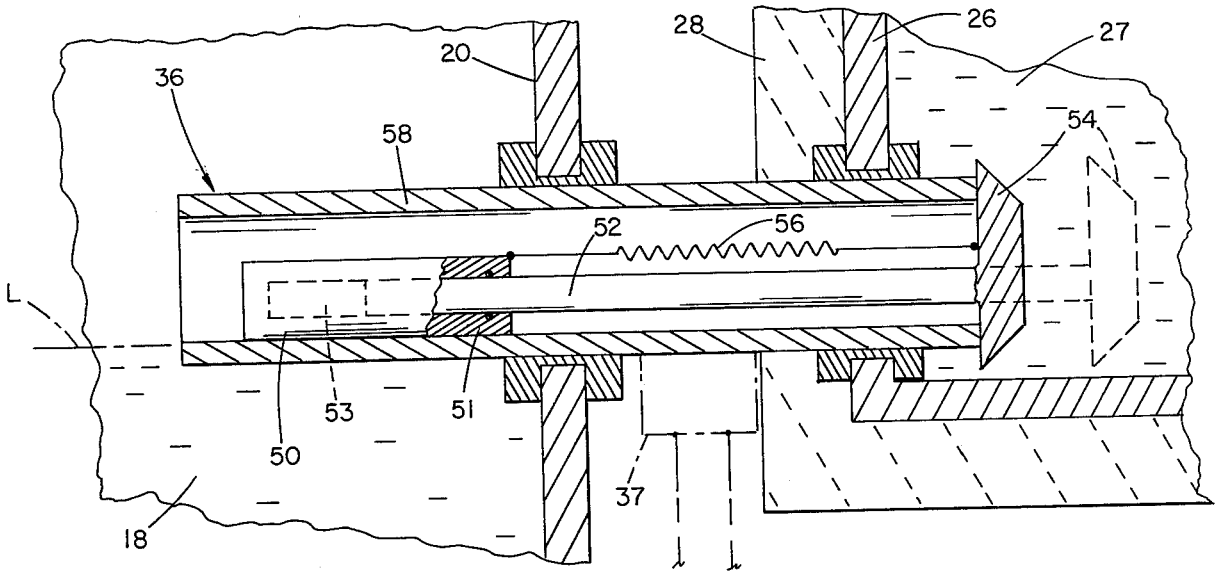
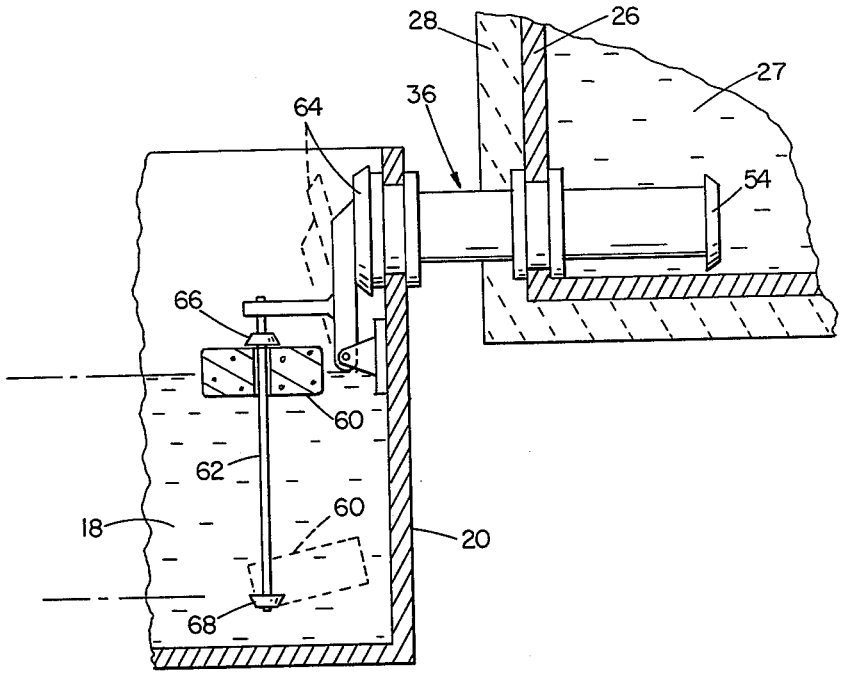
FIG 2

SELF-STERILIZING HUMIDIFIER

This application is related to application Ser. No. 582,818 filed June 2, 1975, now U.S. Pat. No. 4,026,285 issued May 31, 1977, which is a continuation-in-part of application Ser. No. 241,440 filed Apr. 5, 1972 which in turn was a continuation of application Ser. No. 854,427 filed Sept. 2, 1969, the latter two applications being abandoned.

This invention relates to household humidifiers and the like of the type employing an endless form of porous media, for instance a porous belt, associated with a drive for moving the media progressively through immersion and air humidification stations. In this type of humidifier air is blown through the media and is humidified by the evaporation of water carried by the media, the media being replenished by reimmersion.

It is found that the conditions of household humidification, i.e. normal room temperature and the presence of moisture, provide an excellent growth media for pathogenic bateria. For this reason, the presence of the humidifier, intended for the purpose of making a room a healthier environment, can lead to the opposite result.

The principal object of the invention is to provide household humidifiers which, by simple construction, enable automatic sterilization of the water and the porous water-carrying media.

The invention features means for periodically providing heated water at a temperature above about 180° F in the receptacle through which the media passes for immersion, and simultaneous energization of the media drive, the heated water being of sufficient quantity, relative to the size of the media, to expose the media to bacteria-killing conditions through at least one full cycle of media travel whereby, by periodic operation of this mechanism, the media is periodically sterilized and prevented from being a source of continued growth of bacteria and infection.

Particularly preferred embodiments of the invention feature a heater chamber connected to the receptacle via a control, the control adapted to automatically discharge a charge of water heated above about 180° F into the receptacle; the control including a level detector adapted to enable the charge to flow into the receptacle when the receptacle water level reaches a predetermined low level; the control including means to sense the temperature of water in the heater chamber and to enable the flow only when the specified temperature is reached or exceeded; the control in the form of a thermal actuator having sensitive parts exposed to water in both the heater chamber and the receptacle, the actuator adapted to release the charge when water in the receptacle lies below the level of its respective sensitive part, and water in the heater chamber has reached or exceeds the specified temperature; the heater chamber having a predetermined volume for properly sizing the hot water charge and a main reservoir arranged to fill the heater chamber; the heater chamber connected through a restricted inlet to the reservoir to gradually fill under gravity flow; and means provided to de-energize a blower in the air flow path during passage of the media through bacteria-killing conditions in the receptacle, to reduce cooling of the media and the heated water by loss of heat of vaporization.

In certain embodiments the humidifier employs a heater element disposed in the receptacle through which the media travels and means periodically to energize the heater to maintain bacteria-killing conditions, in certain embodiments this heater being the main or only source of the periodic heating for media sterilization. It is particularly advantageous then that the humidifier include means to de-energize any blower in the air flow path during passage of the media through bacteria-killing conditions in the receptacle, to reduce cooling of the media and the water by loss of heat of vaporization; that means be provided for heating all supply water flowing into the receptacle to the specified temperature, to kill bacteria in the supply water; and that in a batch-filling type humidifier a control be employed responsive to a step in the filling procedure for actuating the heater.

Figure 3:
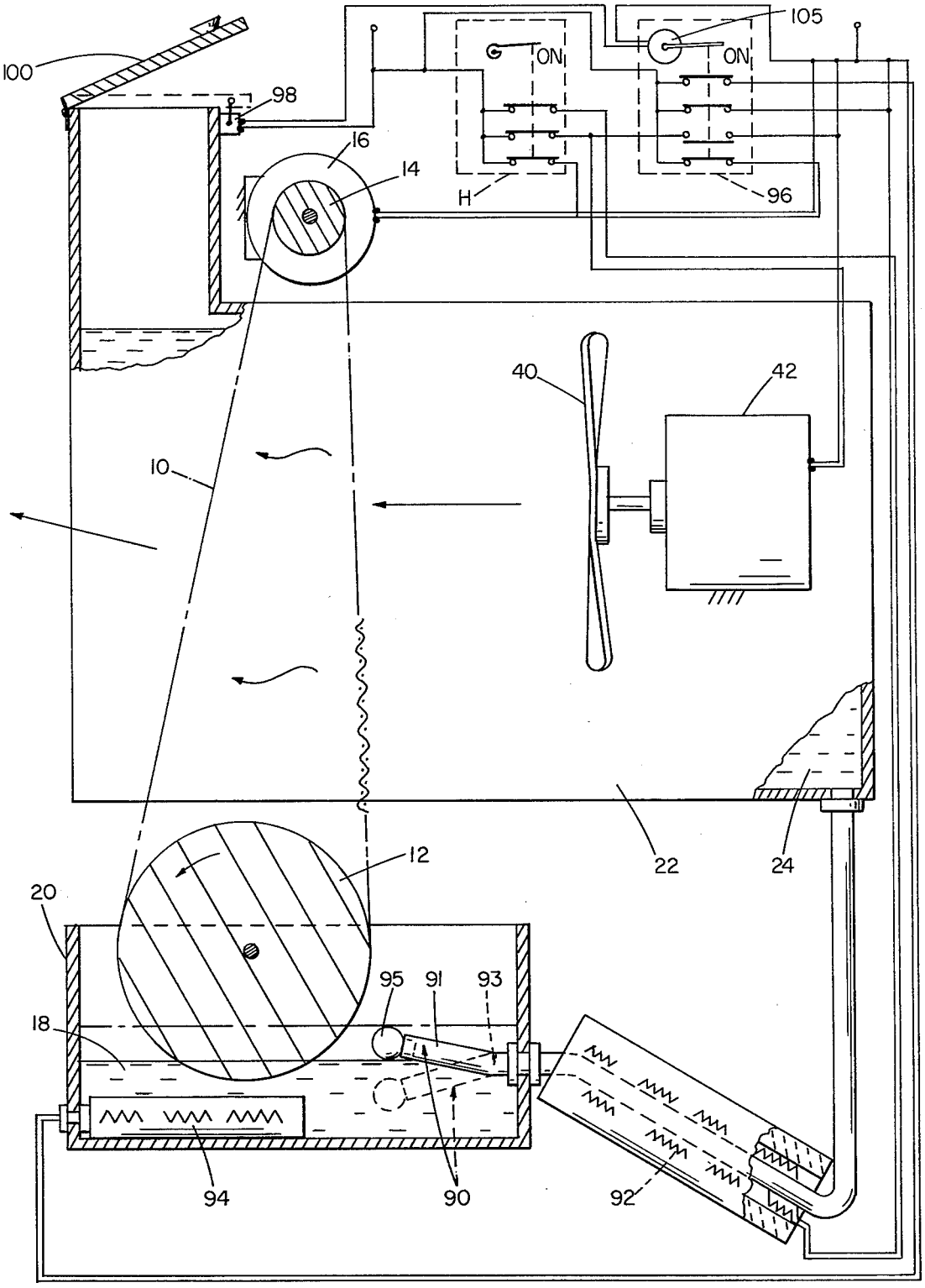

These and other objects and features of the invention will be understood from the following detailed description of preferred embodiments wherein FIG. 1 is a vertical cross section, partially diagrammatic view of a household humidifier of the belt type incorporating an intermediate heated chamber which delivers charges of heated water to the belt receptacle under control of a thermally responsive device;

FIG. 1*a* is a diagrammatic view of details of the control device of FIG. 1;

FIG. 2 is a view similar to a portion of FIG. 1 of an embodiment employing a float control mechanism for discharging the intermediate chamber; and FIG. 3 is a view similar to FIG. 1 of an embodiment employing a heater in the receptacle through which the belt travels.

Referring to FIG. 1 an endless belt of porous media 10 is trained about lower idler pulley 12 and upper drive pulley 14, the latter driven by motor 16. The belt, as it passes under idler pulley 12 is immersed in water 18 contained in receptacle 20. A main reservoir 22 is filled with water 24 by the user. An intermediate chamber 26 provided with insulation 28 contains a small immersion heater 30, e.g. a 100 watt electric heater for heating the water 27 to a temperature of about 180° F. Chamber 26 is vented by vent line 32 and is connected to receive water by gravity flow, progressively through restricted passage 34. A thermally responsive flow control device 36, see also FIG. 1*a*, is responsive to water level in receptacle 20 to discharge to it the volume of water 27 contained in intermediate chamber 26 when the predetermined lower level L of receptacle 20 is reached. The heater 30 is connected to power source 38 for continual operation whenever the humidifier is energized as by a humidistat H. Thus, during operation of the humidifier, as the fan 40 driven by motor 42 forces air through the wetted media, and as the media progresses through its cycle of travel, the water level in immersion receptacle 20 eventually falls to level L. At this time the entire charge of water 27 in intermediate chamber 26 is discharged into receptacle 20 by operation of actuator 36. By virtue of continued operation of the motor 16, the belt is progressively immersed in the heated water, under bacteria-killing conditions. The charge of water defined by the intermediate chamber 26 is sized relative to the length of the filter media and its speed of travel to ensure that the water temperature in the receptacle 20 after receiving the heated charge, remains above bacteria-killing temperature throughout at least one and preferably a number of cycles of travel of the filter media. By this means bacteria on the media is killed and the humidifier substantially sterilized. Soon though, the temperature of the water in receptacle 20 cools, and humidification continues in the normal way, but now starting with a sterilized media, so that few if any bacteria are dispensed to the air. Indeed the media in this instance may be effective to filter bacteria out of the air. When the charge of hot water in chamber 26 has emptied into receptacle 20, the thermally responsive actuator 36 closes. Water progressively enters the chamber 26 through restricted passage 34 and is heated by the immersion heater 30. Within the period it takes for water in receptacle 20 to evaporate, to reach again level L, there has been sufficient time for the intermediate chamber 26 to fill and for the continually operating heater element 30 to heat this water to a temperature above 180° F to permit repetition of the sterilizing action.

In a specific embodiment the media is of approximately 30 inch length and 12 inch width of open celled resinous heat-resistant foam material, formed in an elongated loop with substantially parallel legs. The receptacle 26 closely conforms to the width and thickness of the lower part ot the belt and pulley assembly, to minimize volume, and is sized so that when filled with 1 quart of hot water the media is completely immersed across its width. A typical speed of travel of the media for sterilizing purposes is 5 fpm. The intermediate chamber has a volume of 1 quart and the main reservoir a capacity of 5 gallons.

Referring to FIG. 1*a*, the preferred thermally responsive control 36 is of the type commonly used in automobile radiators. It comprises a power capsule 50 having a metal jacket 51 filled with a mixture of salts 53 which melt at about 180° F and expand. A push rod 52 connected to this power capsule, protrudes through an "o" ring, and carries valve member 54 at its free end. When the salts melt and expand, rod 52 is pushed to the right in the figure, unseating valve 54. When the salts cool, they contract, and assisted by the spring 56, rod 52 moves to the left, closing valve 54. A copper tubing 58 surrounds this assembly, defining the conduit from the intermediate chamber 26 to the receptacle 20. It is open at the end connected to the receptacle, so that water in the receptacle surrounds the power capsule. The tube is open to chamber 26 only when valve 54 is open but its extension is continually in heat conductive relationship to the water in the intermediate chamber 26. So long as the power capsule 50 is surrounded by water of receptacle 20, with valve 54 closed, capsule 50 is cooled below the temperature of the heated chamber 26, due to the heat sink cooling effects of the water, despite heat conduction via tube 58 from the hot water. But this is no longer the case when the level in receptacle 20 is below the capsule 50 and tube 58. The heat conducted from the heated water travels along the tube 58 and heats the power capsule, melting the salts and causing the rod 52 to move to the right and the valve 54 to unseat as mentioned above. The water in the heated chamber then rushes through the tube, maintaining the power capsule hot until the entire heated charge defined by the volume of the heated chamber 26 flows into the receptacle for the sterilizing purpose mentioned. The water coming from the reservoir to refill the intermediate chamber 26 is cold, and, as soon as it strikes the power capsule, the power capsule contracts and the valve 54 reseats, permitting repetition of the cycle.

As shown in FIG. 1, in certain preferred embodiments the thermally responsive control 36 includes a switch 37 which opens a circuit when valve 54 is open. This switch is connected to de-energized the fan motor 42 at the time the hot charge of water is released, to prevent evaporative cooling of the media and of the charge of water, to prolong the sterilization process. Similarly, where it is desired to commence the sterilizing process by means other than level control, a further control not shown may be employed, e.g. to turn the belt motor on and discharge the charge of water in chamber 26 to receptacle 20 in response to lifting the cover 25 of tank 22 for filling the humidifier, etc.

Referring to FIG. 2, the operation is the same except that a float control is employed. A float member 60 is loosely mounted to slide up and down on upright rod 62 and is interconnected with magnetic valve member 64. When the float rises to its up position, defined by stop 66, it forces the magnetic valve to the seated position shown in solid lines. As water evaporates from the belt, the float 60 falls, following the water, until the dotted line position shown is achieved. At that time it engages stop 68, and forces the magnetic valve to unseat, discharging the water from the heated chamber, the valve remaining open until the solid line position of the float 60 is regained, whereupon the valve is closed.

The embodiment of FIG. 3 differs from the foregoing embodiments in that water continually flows into the receptacle 20 subject only to a float control 90, comprising an elastomeric tube 91 having a slit 93 in its upper side, and a float 95 on its end, the slit sealed in the solid line position when the float straightens the tube, the slit open to release water when the float is down, bending the tube to the dotted line position. All water that flows into the receptacle 20 is sterilized in its passage from reservoir 22 to receptacle 20 via heated, insulated line 92. Thereby all water entering reservoir is heated above 180° F and pasteurized, though it cools quickly when it enters the receptacle, hence does not have an overall media-sterilizing effect. A heater element 94 is disposed in the receptacle 20 and connected to control 96. In the embodiment shown this control is activated by switch 98 which closes upon the opening of access door 100 for filling the reservoir. In this embodiment, also, the closing of switch 98 is effective to de-energize fan motor 42 and to energize belt motor 16 via the control. The control includes timer motor 105 which maintains the heater 94 and motor 16 on and fan motor 42 off for a predetermined time to expose the entire length of the media to sterilizing conditions. The heater 94, which in this case may be a 1000 watt heater, is also activated for a predetermined length of time, or under thermally responsive control conditions, to raise the temperature of the water to above 180° F throughout the duration of at least one cycle of the belt through the receptacle. Thereby periodically, again, the media is sterilized.

What is claimed is:

1. In a humidifier for air to be breathed of the type having an endless form of porous media associated with a drive for moving said media progressively through immersion and air humidification stations, a water receptacle at said immersion station through which the corresponding portion of media passes to be wetted and an air flow path at said humidification station for passing air to be humidified through wetted media, the improvement comprising means for periodically providing throughout the effective volume of water in said receptacle a heated water temperature above about 180° F while said drive is actuated, the heated water being sufficient to expose progressively media throughout a full cycle of movement of said media to bacteria-killing conditions, whereby said media is periodically sterilized and prevented from being a source of continued growth of bacteria and infection, said humidifier including means to de-energize a blower in said air flow path during passage of said media through bacteria-killing conditions in said receptacle, to reduce cooling of said media and thereby of said heated water by loss of heat of vaporization.

2. In a humidifier for air to be breathed of the type having an endless form of porous media associated with a drive for moving said media progressively through immersion and air humidification stations, a water receptacle at said immersion station through which the corresponding portion of media passes to be wetted and an air flow path at said humidification station for passing air to be humidified through wetted media, the improvement comprising means for periodically providing throughout the effective volume of water in said receptacle a heated-water temperature above about 180° F while said drive is actuated, the heated water being sufficient to expose progressively media throughout a full cycle of movement of said media to bacteria-killing conditions, whereby said media is periodically sterilized and prevented from being a source of continued growth of bacteria and infection, said humidifier including a heater element disposed in said receptacle, means periodically to energize said heater to maintain said bacteria-killing conditions and means to de-energize a blower in said air flow path during passage of said media through bacteria-killing conditions in said receptacle, to reduce cooling of said media and thereby of said heated water by loss of heat of vaporization.

3. In a humidifier for air to be breathed of the type having an endless form of porous media associated with a drive for moving said media progressively through immersion and air humidification stations, a water receptacle at said immersion station through which the corresponding portion of media passes to be wetted and an air flow path at said humidification station for passing air to be humidified through wetted media, the improvement comprising means for periodically providing throughout the effective volume of water in said receptacle a heated water temperature above about 180° F while said drive is actuated, the heated water being sufficient to expose progressively media throughout a full cycle of movement of said media to bacteria-killing conditions, whereby said media is periodically sterilized and prevented from being a source of continued growth of bacteria and infection, including a heater element disposed in said receptacle and means periodically to energize said heater to maintain said bacteria-killing conditions, and, wherein said humidifier is of the batch-filling type including a control responsive to a step in the filling procedure for actuating said heater.

4. In a humidifier for air to be breathed of the type having an endless form of porous media associated with a drive for moving said media progressively through immersion and air humidification stations, a water receptacle at said immersion station through which the corresponding portion of media passes to be wetted and an air flow path at said humidification station for passing air to be humidified through wetted media, the improvement wherein said receptacle is of limited volume, a separate major water supply for said receptacle, means to admit water in a level-controlled manner from said major supply to said receptacle and means for periodically providing throughout the limited volume of water in said receptacle a heated-water temperature above about 180° F while said drive is actuated, the heated water volume being sufficient to expose progressively media throughout a full cycle of movement of said media to bacteria-killing conditions, whereby said media is periodically sterilized and prevented from being a source of continued growth of bacteria and infection.

5. The humidifier of claim 4 including a heater element disposed in said receptacle and means periodically to energize said heater to maintain said bacteria-killing conditions.

6. The humidifier of claim 5 including means for heating all supply water flowing into said receptacle to said temperature, to kill bacteria in said supply water.

7. In a humidifier for air to be breathed of the type having an endless form of porous media associated with a drive for moving said media progressively through immersion and air humidification stations, a water receptacle at said immersion station through which the corresponding portion of media passes to be wetted and an air flow path at said humidification station for passing air to be humidified through wetted media, the improvement comprising means for periodically providing throughout the effective volume of water in said receptacle a heated water temperature above about 180° F while said drive is actuated, the heated water being sufficient to expose progressively media throughout a full cycle of movement of said media to bacteria-killing conditions, whereby said media is periodically sterilized and prevented from being a source of continued growth of bacteria and infection, said humidifier including a heater chamber connected to said receptacle via a control, said control adapted to automatically discharge a charge of water heated above about 180° F into said receptacle, said charge being of predetermined volume to expose said media at least through one drive cycle to bacteria-killing conditions.

8. The humidifier of claim 7 wherein said heater chamber has a predetermined volume for sizing said hot water charge and a main reservoir arranged to fill said heater chamber.

9. The humidifier of claim 8 wherein said heater chamber is connected through a restricted inlet to said reservoir to gradually fill under gravity flow.

10. The humidifier of claim 7 wherein said control includes a level detector adapted to enable said charge to flow into said receptacle when the receptacle water level reaches a predetermined low level.

11. The humidifier of claim 10 wherein said control includes means to sense the temperature of water in said heater chamber and to enable said flow only when said temperature is reached or exceeded.

12. The humidifier of claim 11 wherein said control comprises a thermal actuator having sensitive parts exposed to water in both said heater chamber and said receptacle, said actuator adapted to release said charge when water in said receptacle lies below its respective sensitive part, and water in said heater chamber has reached or exceeds said temperature.

* * * * *